United States Patent [19]

Morell

[11] 3,999,418

[45] Dec. 28, 1976

[54] METHOD OF MAKING A TAPERED WEDGE

[76] Inventor: Juan Coll Morell, Calle Amilcar, 209, Barcelona, Spain

[22] Filed: Feb. 13, 1976

[21] Appl. No.: 658,099

Related U.S. Application Data

[62] Division of Ser. No. 498,612, Aug. 19, 1974, Pat. No. 3,952,377.

[30] Foreign Application Priority Data

Jan. 25, 1974 Spain ..... 199828

[52] U.S. Cl. ..... 72/377; 104/222; 279/123; 339/273 F

[51] Int. Cl.[2] ..... B21D 53/36

[58] Field of Search ..... 72/362, 367, 377, 376, 72/379, 402; 279/1 SJ, 28, 37, 43, 95, 96, 122, 123; 29/253, 278, 283; 104/222; 403/374; 339/273 R, 273 F, 273 S; 24/115 M, 122.6, 136 R

[56] References Cited

UNITED STATES PATENTS

| | | | |
|---|---|---|---|
| 2,550,036 | 4/1951 | Bechler | 279/43 |
| 2,966,653 | 12/1960 | Jugle | 339/273 |

FOREIGN PATENTS OR APPLICATIONS

| | | | |
|---|---|---|---|
| 475,728 | 5/1929 | Germany | 24/115 M |

*Primary Examiner*—Lowell A. Larson
*Attorney, Agent, or Firm*—Steinberg & Blake

[57] ABSTRACT

A method of making a tapered wedge for use in gripping a multi-ply rope or cable, especially concrete-reinforcing tendons, wherein the tapered wedge is circumferentially divided into a plurality of parts surrounding an axial aperture for the rope or cable. Each of these parts is deformed, for at least a part of its axial length, by pressing only its circumferential side edges inwardly toward the axis of the aperture so as to displace its interior surface adjacent these edges inwardly as well as to displace exterior surface regions inwardly.

3 Claims, 7 Drawing Figures

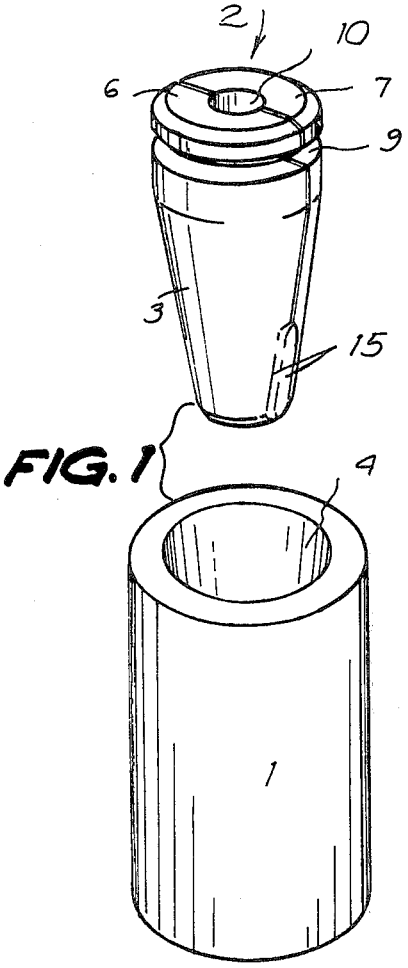
FIG. 1
FIG. 2
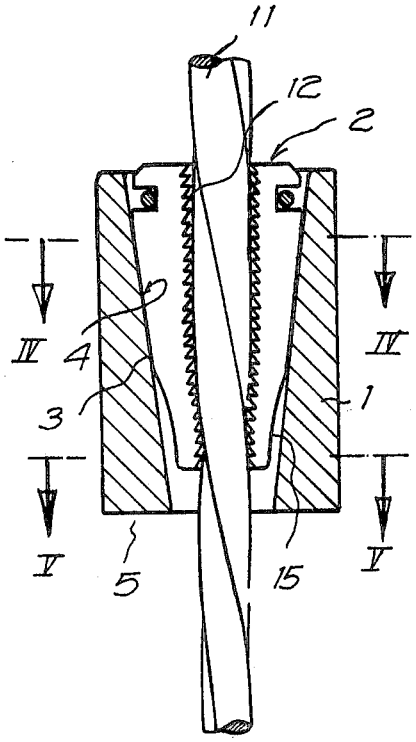

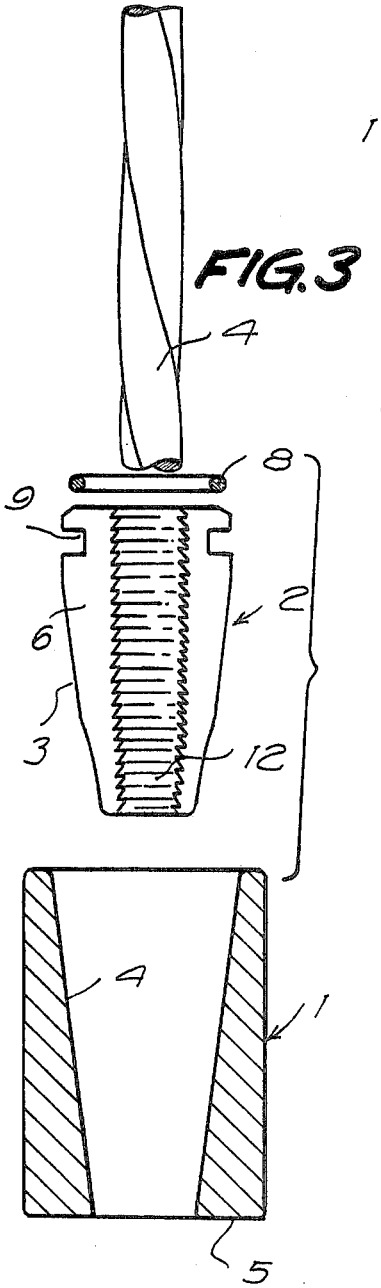
FIG. 3
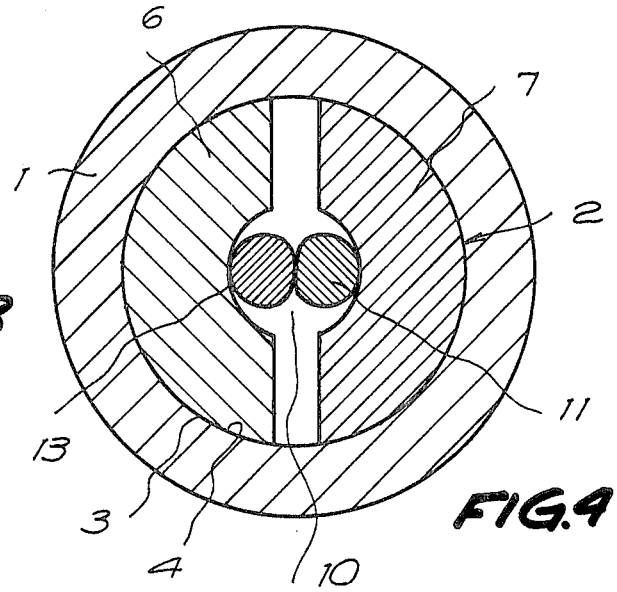
FIG. 4
FIG. 5
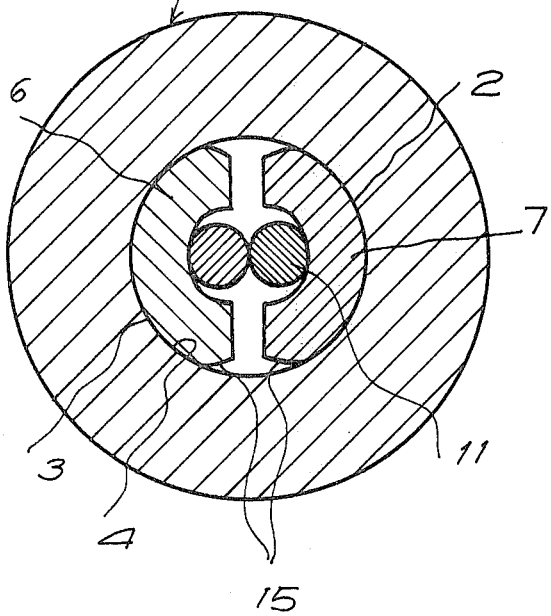

FIG. 6
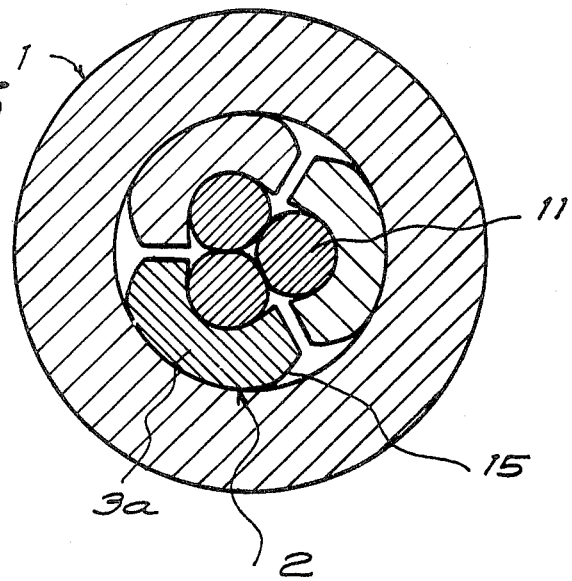
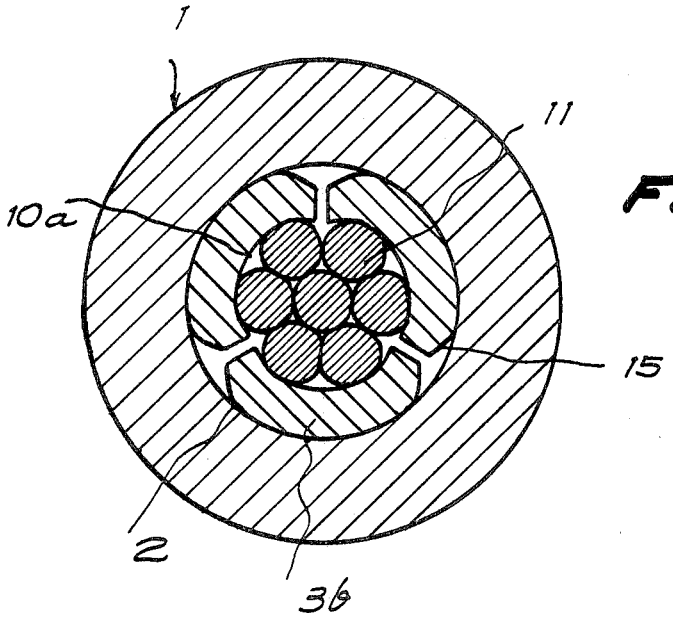
FIG. 7

METHOD OF MAKING A TAPERED WEDGE

CROSS REFERENCE TO RELATED APPLICATION

The present application is a division of copending application Serial No. 498,612, filed Aug. 19, 1974, now U.S. Pat. No. 3,952,377.

BACKGROUND OF THE INVENTION

The invention relates to a method of making a tapered wedge for use in gripping a multi-ply rope or cable, particularly in the anchoring of tendons used as reinforcements in pre-stressed or post-stressed concrete building members or structures.

In anchoring concrete-reinforcing tendons, it is well known to use wedges in the form of conical sleeves which are received in conical bores and are divided circumferentially into a plurality of complementary parts surrounding an axial aperture for the rope or cable. Although this system can yield satisfactory results, some important problems arise when it is used with stranded elements, e.g. multi-ply tendons comprising 2, 3 or 7 wires, all these arrangements being equally well known in present-day practice.

In fact, the wedge assembly or gripper to be employed with a multi-wire tendon is required to possess an internal diameter corresponding to the external enveloping circumference of the various wires, and contact between the internal surface of the wedges and the wires takes place exclusively along a line corresponding to the most external generatrix of each one of the said wires. The radial load produced by the wedging of the gripper means is concentrated along the said lines and attains extremely high specific values which may even cause rupture of the wedges or of the wire itself.

An attempt has been made to remove this disadvantage by imparting to the internal surface of the wedge a shape more or less complementary to the outer surface of the multi-wire tendon assembly, but this has involved costly manufacturing processes, and the results have not been totally satisfactory.

SUMMARY OF THE INVENTION

It is an object of this invention to provide a gripping wedge for multi-ply rope or cable which may be manufactured in a simple manner and provides for engagement and load transfer between the wedge parts and the rope or cable which is adequate for all practical purposes.

According to this invention, there is provided a conical wedge for gripping a multi-ply rope or cable, wherein the wedge is circumferentially divided into a plurality of complementary parts surrounding an axial aperture for the rope or cable, each of the said parts having, for at least part of its axial length, a deformation produced by inward pressing its circumferential edges so as to displace its interior surface adjacent said edges inwardly.

The form of the interior surface of the deformed portions of the wedge parts can be adapted in accordance with the outer surface of the single wire or the group of wires engaged by the wedge part so as to provide contact over a wider area than the line contact mentioned above. The pinched-in shape given by the deformation also assists in the guiding of the rope or cable in the wedge.

Preferably the deformation is confined to a region at the narrow axial end of the wedge.

BRIEF DESCRIPTION OF THE DRAWINGS

The accompanying drawings show, by way of example and without limitation of the scope of the present invention, and in diagrammatic form, several preferred embodiments of the invention. In the drawings:

FIG. 1 is a perspective view of an anchoring device including a wedge embodying the invention, shown separated from the anchoring sleeve or bushing;

FIG. 2 is a view in axial section of the device of FIG. 1 in this case in the mounted position, securing a tendon consisting of two wires;

FIG. 3 is an exploded view of the parts shown in FIG. 2;

FIG. 4 is a cross-section on the line IV—IV of FIG. 2 on a larger scale;

FIG. 5 is a cross-section on the line V—V of FIG. 2; and

FIGS. 6 and 7 are cross-sections corresponding to that of FIG. 5 through two further wedges embodying the invention, suitable for gripping tendons having three and seven wires respectively.

DESCRIPTION OF THE PREFERRED EMBODIMENTS

The anchoring devices shown in the drawings comprise a sleeve or bush 1 having a conical bore 4 and the gripping wedge 2, the outer conical surface 3 of which is complementary to the bore 4 in the sleeve 1. In use the lower face 5 of the sleeve 1 bears against the associated face of a bearing plate which takes the load (not shown).

The wedges 2 are circumferentially divided into two, or in the cases of FIGS. 6 and 7 three, complementary parts which are held in position by a resilient ring 8 in a groove 9 near the wider axial end. The ring 8 permits relative radial movement of the parts.

The wedge 2 has an axial cylindrical bore or aperture 10 bounded by the internal surfaces 12 of the wedge parts which are toothed or serrated for enhanced adhesion to the tendon 11 disposed within it. When they are fitted to the sleeve as shown in FIG. 4, the parts trap the tendon between them. The two wires of the tendon 11 have been shown flattened to an exaggerated degree, so as to facilitate understanding of the invention.

At the region shown in FIG. 4, the two wires of the tendon 11 engage the inner surface of the wedge parts at two narrow strips, indicated by reference numeral 13 and extending in helical form along the wedge. The remainder of the inner surface of the wedge, located at both sides of the said contact zone, is completely separated from the wires and takes no part in the transmission of loads, so that the entire force produced in the anchorin g of the tendons is concentrated in the radial zones comprising the said contact strips.

According to the teaching of the invention, the two wedge parts have been subjected, by any suitable conventional method, to deformation by inward pressing, e.g. pressing in directions parallel to the plane of separation of the two parts of the set. The region of deformation is confined to a fraction of the axial length of the wedge parts and the location thereof is at the narrower end of the wedge. Consequently, the inner surface of the wedge parts adjacent the circumferential edges is displaced inwardly as will be ascertained by comparing FIGS. 4 and 5; although the Figures are in different section planes, the inner surface 12 of the wedge would have the same cylindrical form in FIG. 5 as in FIG. 4 prior to the pressing operation.

The magnitude of the said pressing is selected in such manner that the deformation imparts to the inner surface of the wedges a shape complementary to the surface of the wires in the zone under consideration, in such manner that there is produced in the anchoring arrangement a much more extensive engagement surface between the wedge and the wires, and, furthermore, the wires are guided on entry, as will be gathered from FIG. 5.

In the embodiments illustrated, the deformation is confined to regions 15 at the narrow ends of the wedge parts, but it may be applied to the whole length of the circumferential edges of the parts, particularly if the wedge is circumferentially divided not in axial planes as illustrated but along helical surfaces in a known manner. In the embodiments illustrated the circumferential edges of the parts are inwardly pressed towards the central axial plane of each part, but where the wedge is divided along helical surfaces, the edges are pressed towards a surface passing through the axis and dividing the part symmetrically.

FIG. 6 illustrates the application of the invention to a wedge for gripping a three-wire cable 11, the wedge 2 being divided into three parts 3*a* each of which occupies 120° and is deformed in a similar manner to that described above at its narrow end. Each wedge part 3*a* embraces one of the wires of the cable 11.

In the embodiment of FIG. 7, the inner surface 10*a* of each of the three wedge parts 3*b* embraces and engages the outer flanks of an adjacent pair of the six outer wires of the seven-wire tendon 11. At their narrow ends, the wedge parts are deformed by inward pressing of their circumferential edges so that contact with the wires is improved. Consequently transmission of load and the gripping action is also improved.

Another important advantage obtainable with the invention is that the wires constituting the stranded element are guided at the centers of the wedge sectors or parts and the risk that they enter the gaps or slots between the wedge parts, which would result in inadequate anchoring as occurs with standard gripper means, is reduced.

While the invention has been illustrated above by reference to preferred but non-limitative embodiments thereof, it will be understood by those skilled in the art that various changes may be made without departing from the spirit and scope of the invention and it is intended to cover all such changes and modifications by the appended claims.

What is claimed is:

1. Method of making a tapered wedge which is circumferentially divided into a plurality of parts surrounding an axial aperture for a rope or cable, including the step of deforming each part, for at least part of its axial length, by pressing only its circumferential side edges inwardly toward the axis of said aperture so as to displace its interior surface adjacent said edges inwardly as well as to displace exterior surface regions inwardly.

2. Method as recited in claim 1 and wherein said pressing is performed at only a part of each circumferential side edge.

3. Method as recited in claim 2 and wherein said pressing is confined to a part of each circumferential side edge which is at a region of a smaller end of each part.

* * * * *